US005749743A

United States Patent [19]

Harada et al.

[11] Patent Number: 5,749,743

[45] Date of Patent: May 12, 1998

[54] BULB SOCKET FOR VEHICULAR LAMP

[75] Inventors: Tadashi Harada; Kihachiro Uchida, both of Shizuoka, Japan

[73] Assignee: Koito Manufacturing Co., Ltd., Tokyo, Japan

[21] Appl. No.: 581,427

[22] Filed: Dec. 29, 1995

[30] Foreign Application Priority Data

Jan. 14, 1995 [JP] Japan ..... 7-021047
Oct. 17, 1995 [JP] Japan ..... 7-293531

[51] Int. Cl.[6] ..... H01R 4/50

[52] U.S. Cl. ..... 439/336

[58] Field of Search ..... 439/336, 337, 439/671, 672, 332, 333, 334, 335, 842, 744, 746, 854, 855

[56] References Cited

U.S. PATENT DOCUMENTS 4,804,343 2/1989 Reedy ..... 439/336
5,087,213 2/1992 Drapcho et al. ..... 439/336
5,154,645 10/1992 Harada et al. ..... 439/736
5,306,173 4/1994 Suzuki ..... 439/336

*Primary Examiner*—Gary F. Paumen
*Assistant Examiner*—Yong Ki Kim
*Attorney, Agent, or Firm*—Sughrue, Mion, Zinn, Macpeak & Seas, PLLC

[57] ABSTRACT

A bulb socket which includes a tubular socket body for receiving a base of a bulb, a positive terminal insertion portion which is formed at the socket body and opens in a direction perpendicular to the axis of the socket body, a positive terminal inserted into the socket body through the positive terminal insertion portion and held at an inner bottom portion of the socket body, and a negative terminal supported on an inner peripheral surface of the socket body. The positive terminal insertion portion extends diametrically of the socket portion and has a length larger than the diameter of the socket portion. The positive terminal has a length larger than the diameter of the socket body, and is supported in the positive terminal insertion portion.

15 Claims, 10 Drawing Sheets

BULB SOCKET FOR VEHICULAR LAMP

BACKGROUND OF THE INVENTION

The present invention relates to a bulb socket, and more particularly to a bulb socket which is made compact in size while enhancing the reliability of electrical contact with a bulb attached to the bulb socket.

With the recent advent of thin, compact vehicular lamp devices, the bulb sockets used in such lamp devices have now been required to have a compact design. Above all, the length in the axial direction of a tubular socket body has been increasingly required to be reduced. To this end, a bulb socket as disclosed in commonly assigned Japanese Utility Model Unexamined Publication No. 6-68363 has been proposed.

In this proposed bulb socket, whose cross-sectional structure is shown in FIG. 14, a positive terminal 102 for contact with a positive electrode 12 formed on a base 11 of a bulb 1 is provided in a bottom portion of a socket body 101, and this positive terminal 102 is mounted within the socket body 101 through an insertion portion 103 extending perpendicular to the axis of the tubular socket body 101. With this construction, the length of the tubular socket body 101 in its axial direction is reduced while ensuring a required resilient force at a contact 102*a* of the positive terminal 102, and also there is achieved an advantage that the positive terminal 102 can be easily inserted into the socket body 101. In this bulb socket, an engagement hole is formed through the positive terminal 102 at a portion thereof disposed centrally of the width thereof, and a projection 104, formed on the inner bottom surface of the socket body 101, is engaged in this engagement hole, thereby preventing displacement of the positive terminal 102.

However, a study of this bulb socket has indicated that there is still room for certain improvements. Namely, the positive terminal 102 is bent into a generally recumbent U-shape in the tubular socket body 101. If the inner diameter of the socket body 101 is reduced so as to meet the requirement for a compact bulb design, it is necessary to reduce the bending length L1 (FIG. 14) of the positive terminal 102. The bending length L1 is related to the resilient force of the positive terminal 102; for a constant axial length of the tubular socket body 101 (and hence a constant dimension L2, obtained by subtracting the length of that portion of the bulb base 11 inserted into the socket body 101 from the axial length of the socket body 101), the larger the bending length L1, the larger the overall length of the positive terminal 102 can be made, and the larger this overall length, the greater the resilient force.

However, if the axial length of the socket body 101 as well as its inner diameter is reduced, the overall length of the positive terminal 102 must be reduced, and therefore the resilient force of the positive terminal is reduced, so that the force of electrical contact of the positive terminal with the positive electrode 12 of the bulb 1 is reduced, thus lowering the reliability of the contact.

It may be further noted that, as described in the above publication, if the positive terminal is bent, for example, into an S-shape in order to increase the overall length thereof, the axial length of the socket body 101 must be increased, which is contrary to the goal of reducing the size of the socket body.

SUMMARY OF THE INVENTION

It is an object of this invention to provide a bulb socket in which the inner diameter of a tubular socket body can be reduced without increasing its axial length, thereby enabling a compact design of the socket body while securing a sufficient resilient force of a positive terminal.

According to the present invention, there is provided a bulb socket comprising a tubular socket body for receiving a base of a bulb; a positive terminal insertion portion which is formed at a bottom portion of the socket body and which opens in a direction perpendicular to the longitudinal axis of the socket body; a positive terminal which is inserted into the socket body through the positive terminal insertion portion and is held on an inner bottom portion of the socket body, the positive terminal being adapted to contact a positive electrode formed on the base of the bulb; and a negative terminal which is supported on the inner peripheral surface of the socket body and is adapted to contact a negative electrode on the base of the bulb; wherein the positive terminal insertion portion, which is formed generally diametrically of the socket body, has a length larger than the diameter of the socket body, and the positive terminal insertion portion has the positive terminal supported therein along the length thereof, the positive terminal having a length larger than the diameter of the socket body.

In the present invention, a flange larger in diameter than the socket body is formed at a bottom portion of the socket body, and the positive terminal insertion portion projects from bottom surfaces of the socket body and the flange in the direction of the axis of the socket body, opposite ends of the positive terminal insertion portion being disposed generally at an outer periphery of the flange. In this case, the positive terminal insertion portion, formed diametrically of the socket body, can receive one or two positive terminals therein (in the case of two positive terminals, they are held parallel to each other), the positive terminal being adapted to contact the positive electrode formed on the base of the bulb.

The positive terminal has a pair of wings respectively formed on and projecting from opposite sides thereof, the wings being engageable with respective ones of pair of projections provided in a guide groove provided in the positive terminal insertion portion, the positive terminal being inserted into the guide groove, and each of the wings having a slanting front end portion which slides over the projection when inserting the positive terminal into the positive terminal insertion portion. Alternatively, the positive terminal has a pair of wings formed on and projecting from respective opposite sides thereof, a guide groove of the positive terminal insertion portion for receiving the positive terminal is generally equal in width to the positive terminal, and a pair of recesses for respectively retaining the wings are formed in respective opposite side walls of the guide groove.

DESCRIPTION OF THE PREFERRED EMBODIMENTS OF THE INVENTION

Figure 1:
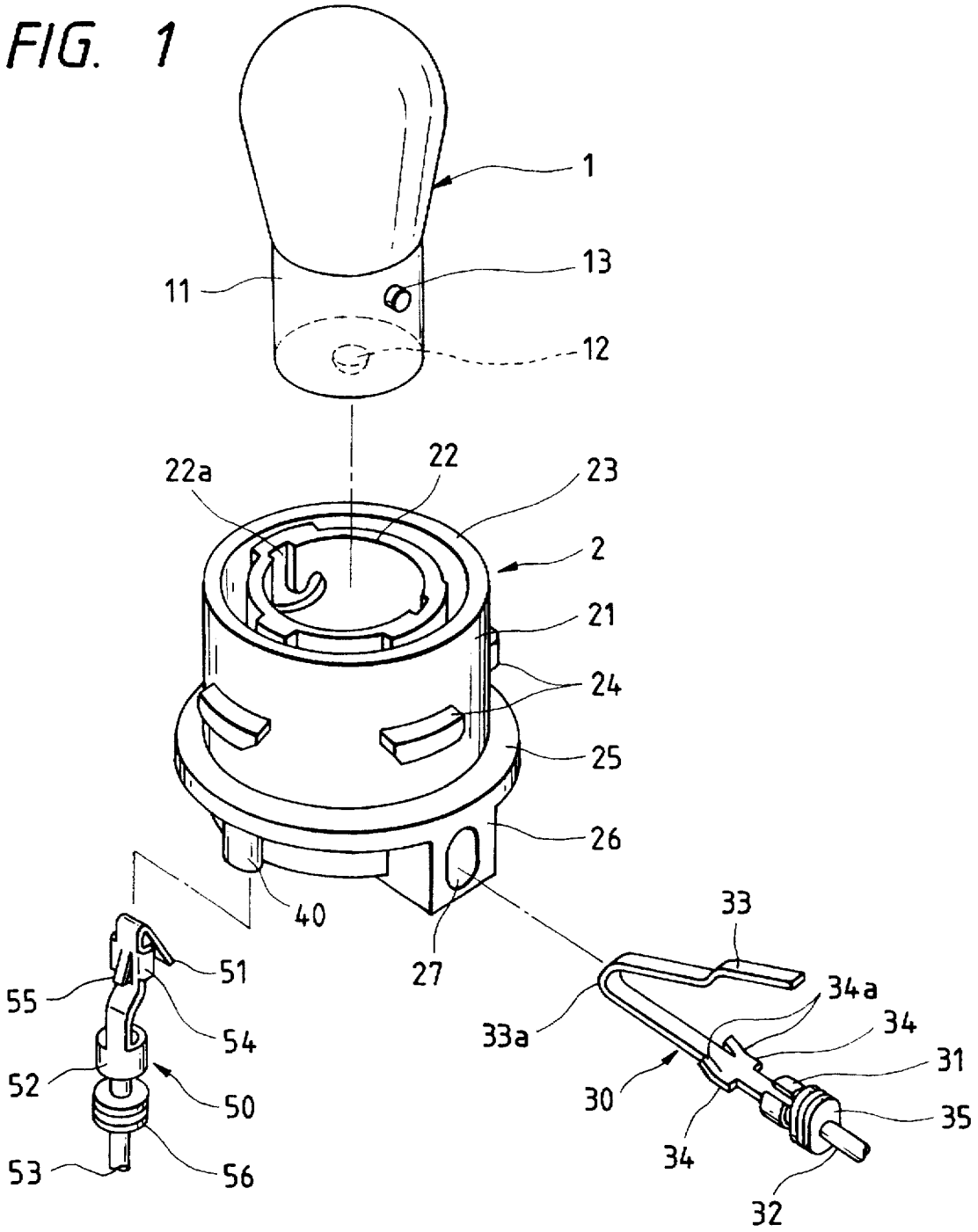
FIG. 1 is a partly exploded, perspective view of a first embodiment of the present invention.

Preferred embodiments of the present invention will now be described with reference to the drawings. FIG. 1 is a partly exploded, perspective view of a first embodiment of the invention. In this drawing, a bulb 1 with a base has a filament sealed in a glass bulb portion, and a peripheral surface of the base 11 supporting the glass bulb serves as a negative electrode. A positive electrode 12 is formed on a central portion of a distal end of the base 11 through an insulating material. An engagement pin 13 for retaining the bulb projects radially outwardly from the peripheral surface of the base 11.

Figure 2A:
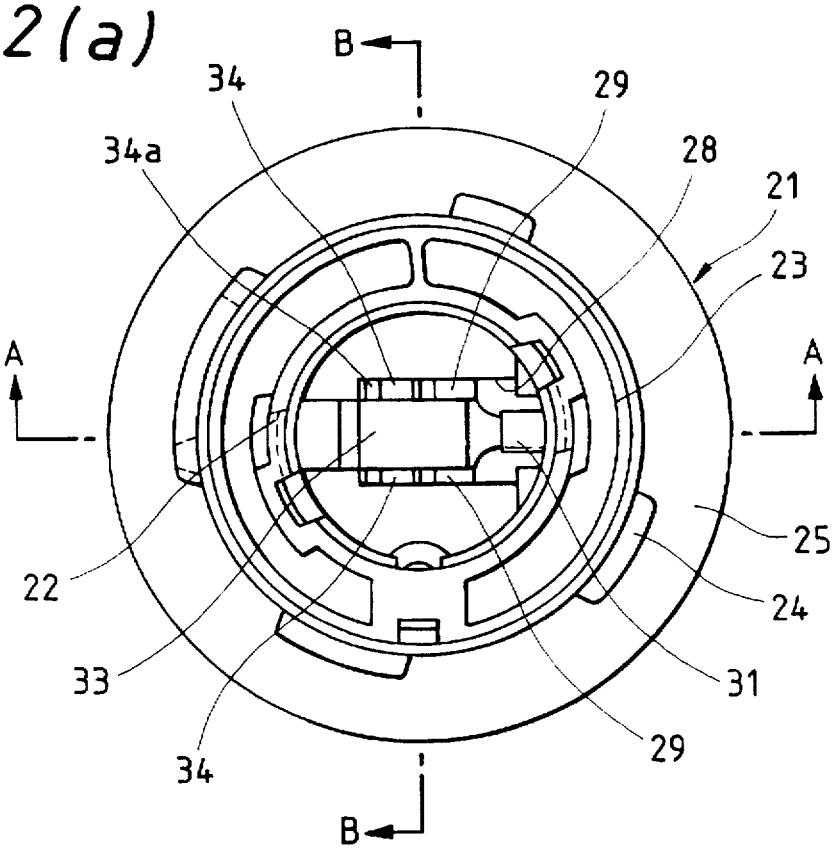
FIGS. 2(*a*) and 2(*b*) are a plan view and a bottom view, respectively of a first embodiment of the invention.
Figure 2B:
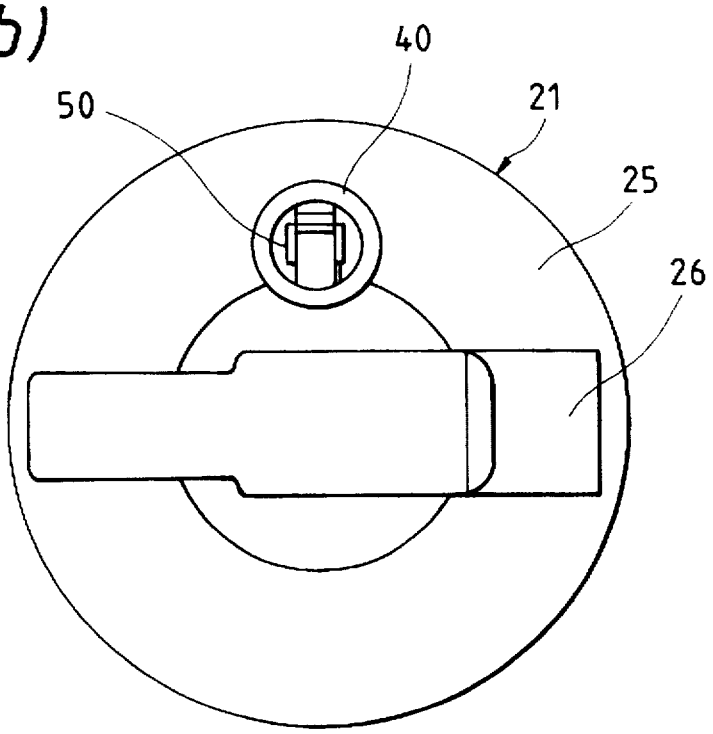
Figure 3A:
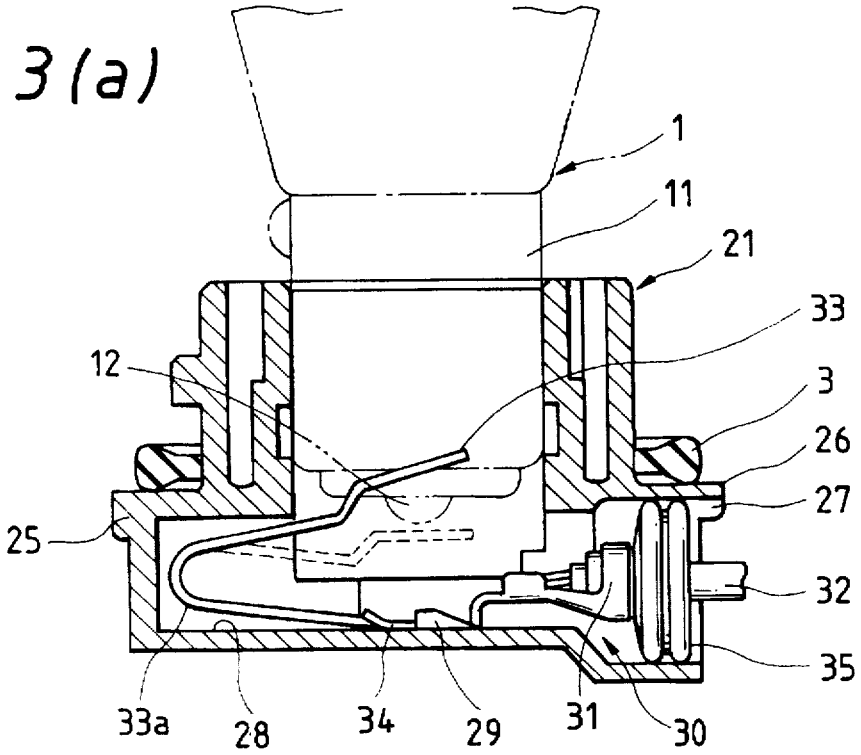
FIGS. 3(*a*) and 3(*b*) are cross-sectional views taken along the line A—A and the line B—B, respectively, in FIG. 2(*a*)
Figure 3B:
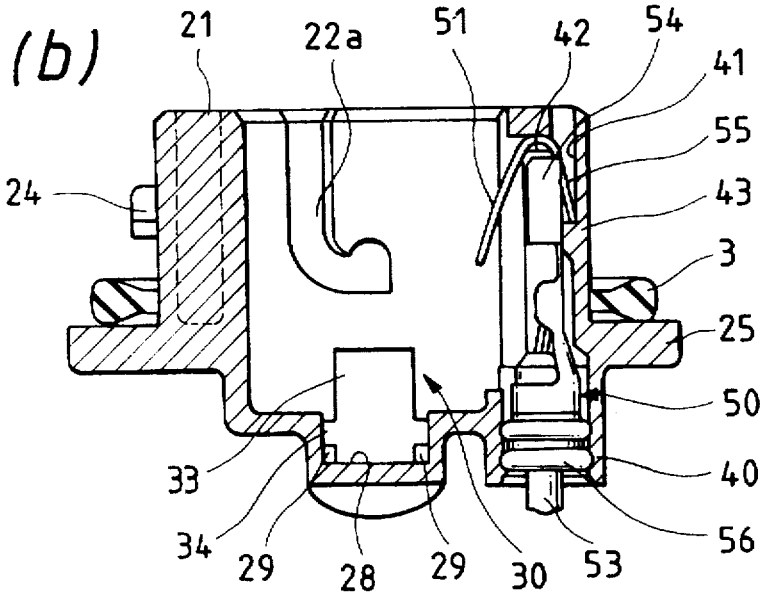

Reference numeral 2 denotes a bulb socket, and FIGS. 2(*a*) and 2(*b*) are, respectively, a plan view and a bottom view of this bulb socket, while FIGS. 3(*a*) and 3(*b*) are cross-sectional views taken along the line A—A and the line B—B of FIG. 2 (*a*), respectively. Referring to these drawings, a socket body 21, which is made of an insulating material such as a resin, has a double-wall cylindrical construction of a short length with a closed bottom. The base 11 of the bulb 1 is adapted to be inserted into an inner tube 22 of the socket body. A J-shaped groove 22*a* is formed in an inner peripheral surface of the socket body 21, and the engagement pin 13 on the bulb 1 is engaged in this J-shaped groove to retain the bulb relative to the socket body. Bayonet engagement portions 24, used for attaching the bulb socket to a lamp device, as well as a circular flange 25, are formed integrally on the outer peripheral surface of an outer tube 23 of the socket body 21.

A positive terminal insertion portion 26 is formed at a bottom portion of the socket body 21, extending perpendicular to the axis of the tubular socket body 21. The positive terminal insertion portion 26 has an insertion port or opening 27 disposed in a plane parallel to the axis of the tubular socket body, and the inner bottom portion of the socket body 21 communicates with the exterior through this insertion port 27. The positive terminal insertion portion 26 extends generally over the entire diametrical length of the flange 25 formed on the socket body 21, and therefore the insertion port 27 in the insertion portion 26 is disposed radially outwardly of the outer tube 23 of the socket body 21. The insertion port 27 is slightly elongated in the direction of the axis of the tubular socket body 21, and a guide groove 28 corresponding to the insertion port 27 is formed in the inner bottom surface of the socket body 21 along the axis of the insertion port 27, the guide groove 28 having a width corresponding to the width of a positive terminal. A pair of opposed, tapered projections 29 are formed integrally on a bottom surface of the guide groove 28, and are spaced a predetermined distance from each other in the direction of width.

The positive terminal 30 is inserted into the interior of the socket body 21 through the insertion port 27 of the positive terminal insertion portion 26. As shown in FIG. 1, the positive terminal 30 is formed by bending an elongated, narrow metal sheet. A fixing portion 31 of a generally annular shape, formed at one end thereof, clampingly holds a distal end of a positive cord 32, thereby electrically connecting the positive terminal 30 to the positive cord 32. The other end portion of the positive terminal is formed into a contact portion 33 for contact with the positive electrode 12 of the bulb 1. This contact portion 33 first extends substantially straight, and then is bent upwardly to assume a generally U-shape. An upper portion of the contact portion 33 is further bent in a crank-shaped manner, with its distal end portion directed obliquely upwardly. A pair of wings 34 of a very small size are formed on respective opposite side edges of the proximal end portion of the contact portion 33, projecting in the direction of the width thereof. A front end portion 34*a* of each wing 34 is bent slightly upwardly.

Figure 4:
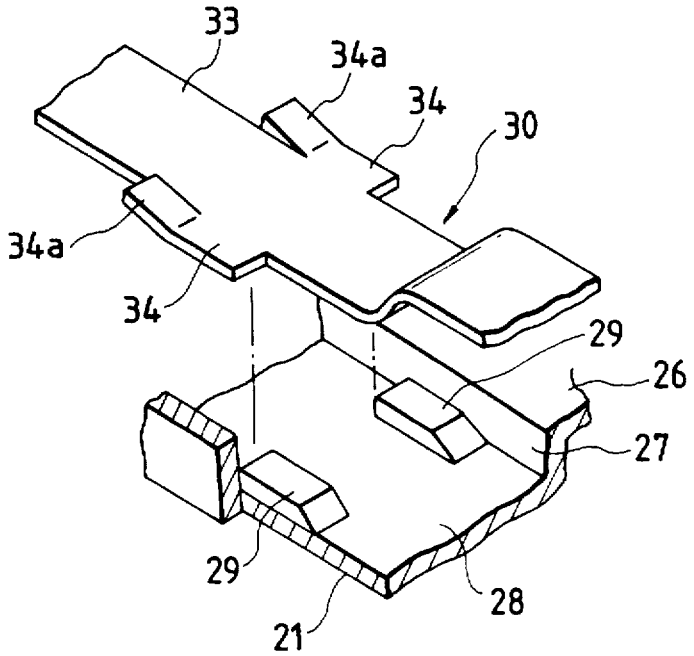
FIG. 4 is an enlarged perspective view showing a positive terminal and a projection.

The positive terminal 30 is inserted into the interior of the socket body 21 through the insertion port 27 of the positive terminal insertion portion 26, with its front end first introduced thereinto. During this inserting operation, the front end portions 34*a* of the wings 34 are guided respectively by the slanting surfaces of the projections 29 (see FIG. 4, which shows important portions on an enlarged scale), and then slide over the respective projections 29, so that the wings 34 are retained respectively by the projections 29. In this condition, the positive terminal 30 is supported within the socket body 21. At this time, a U-shaped bent portion 33*a* of the contact portion 33 is received in that portion of the positive terminal insertion portion 26 disposed radially outwardly of the outer tube 23 of the socket body 21. A rubber bushing 35 of a generally oval shape, fitted on the positive cord 32, is fitted in the insertion port 27, thereby preventing water from intruding through the insertion port 27.

A negative terminal insertion portion 40 in the form of a small cylinder is formed at the bottom portion of the socket body 21 at the outer peripheral portion thereof, and a groove 41 is formed axially in the negative terminal insertion portion 40 and a region disposed outwardly of the outer periphery of the inner tube 22 of the socket body 21. The groove 41 is disposed perpendicular to the positive terminal insertion portion 26, extending from the bottom portion of the socket body 21 to the open end thereof. A stopper groove 42 for receiving an intermediate portion 54 of a negative terminal 50 is provided adjacent the groove 41. A radially inwardly projecting lance engagement projection 43 is formed on that portion of the inner surface of the outer tube 23 facing the groove 41.

The negative terminal 50 is inserted and supported in the groove 41. As shown in FIG. 1, the negative terminal 50 is formed by bending a narrow, elongated metal sheet, with its distal end portion 51 bent into a U-shape. A bendable portion provided at its proximal end portion clampingly holds a negative cord 53, thereby electrically connecting the negative terminal 50 to the negative cord. Opposite side portions of the intermediate portion 54 have a U-shaped cross-section, and a base portion thereof is stamped out to provide a lance 55.

The negative terminal 50 is inserted into the negative terminal insertion portion 40 with its front end first introduced thereinto, and is further inserted into the socket body 21 through the groove 41. As a result, the intermediate portion 54 is fitted in the stopper groove 42, and the lance 55 is engaged with the lance engagement projection, so that the negative terminal 50 is supported on the socket body 21. In this supported condition, the distal end portion 51 of the negative terminal 50 is disposed radially inwardly of the inner peripheral surface of the inner tube 22.

S An annular rubber bushing 56 fitted on the negative cord 53 is fitted in an inlet of the negative terminal insertion portion 40, thereby preventing water from intruding into the interior of the socket. In FIGS. 3(*a*) and 3(*b*), reference numeral 3 denotes an O-ring which forms a watertight seal between the bulb socket 2 and the lamp device when the bulb socket is attached to the lamp device.

When the bulb 2 is inserted into the bulb socket 2, the negative electrode (peripheral surface) on the base 11 contacts the distal end portion 51 of the negative terminal 50, and the positive electrode 12 contacts the positive terminal 30, as indicated in broken lines in FIG. 3(*a*), thereby energizing the bulb 1. At this time, since the U-shaped bent portion 33*a* of the contact portion 33 of the positive terminal 30 is disposed in that portion of the positive terminal insertion portion 26 disposed radially outwardly of the outer tube 23 of the socket body 21, the overall length of the contact portion 33 is relatively long as compared with the diameter of the tubular socket body 21. Therefore, even if the inner diameter of the socket body 21 is reduced, the overall length of the contact portion 33 can be sufficiently long, thus securing a sufficient resilient force.

With this construction, the dimension of the positive terminal 30, received in the socket body 21, is reduced in the direction of the axis of the socket body, so that the axial length of the socket body 21 can be reduced, as can the diameter of the socket body 21, thereby achieving a compact design of the bulb socket 2. On the other hand, the positive terminal 30 can be made sufficiently long that the positive terminal 30 can be contacted with the positive electrode 12 of the bulb 1 with a sufficient resilient force, thereby enhancing the reliability of the electrical contact.

The positive terminal 30 is inserted in the direction perpendicular to the axis of the tubular socket body 21, and the supporting of the positive terminal 30 is effected within the positive terminal insertion portion 26, and therefore the bottom portion of the socket body 21 does not need to be thickened. This also contributes to the reduction of the length of the socket body 21, and thus to the compact design of the bulb socket 2.

The positive terminal insertion portion 26 has an elongated, rectangular box-like configuration extending diametrically of the socket body 21 at the bottom portion thereof. Therefore, when the socket body 21 is to be mounted in an opening of the lamp device (not shown) through the bayonet construction including the bayonet portions 24, the socket body 21 can be rotated about the axis thereof by holding the positive terminal insertion portion 26 with the hand. This provides an advantage that the attachment and detachment of the bulb socket 2 can be easily carried out.

The positive cord 32 extends outwardly from the positive terminal insertion portion disposed perpendicular to the axis of the socket body 21. If the cord were extended outwardly from the bottom of the socket body 21 along the axis of the socket body, it would be necessary to provide a space in which the cord can be perpendicularly bent immediately after the cord comes out of the socket body. In the invention, such a space is not required, and accordingly the space occupied by the bulb socket upon attachment to the lamp device is saved, which achieves the same advantage as obtained when the length of the bulb socket is reduced.

Figure 5:
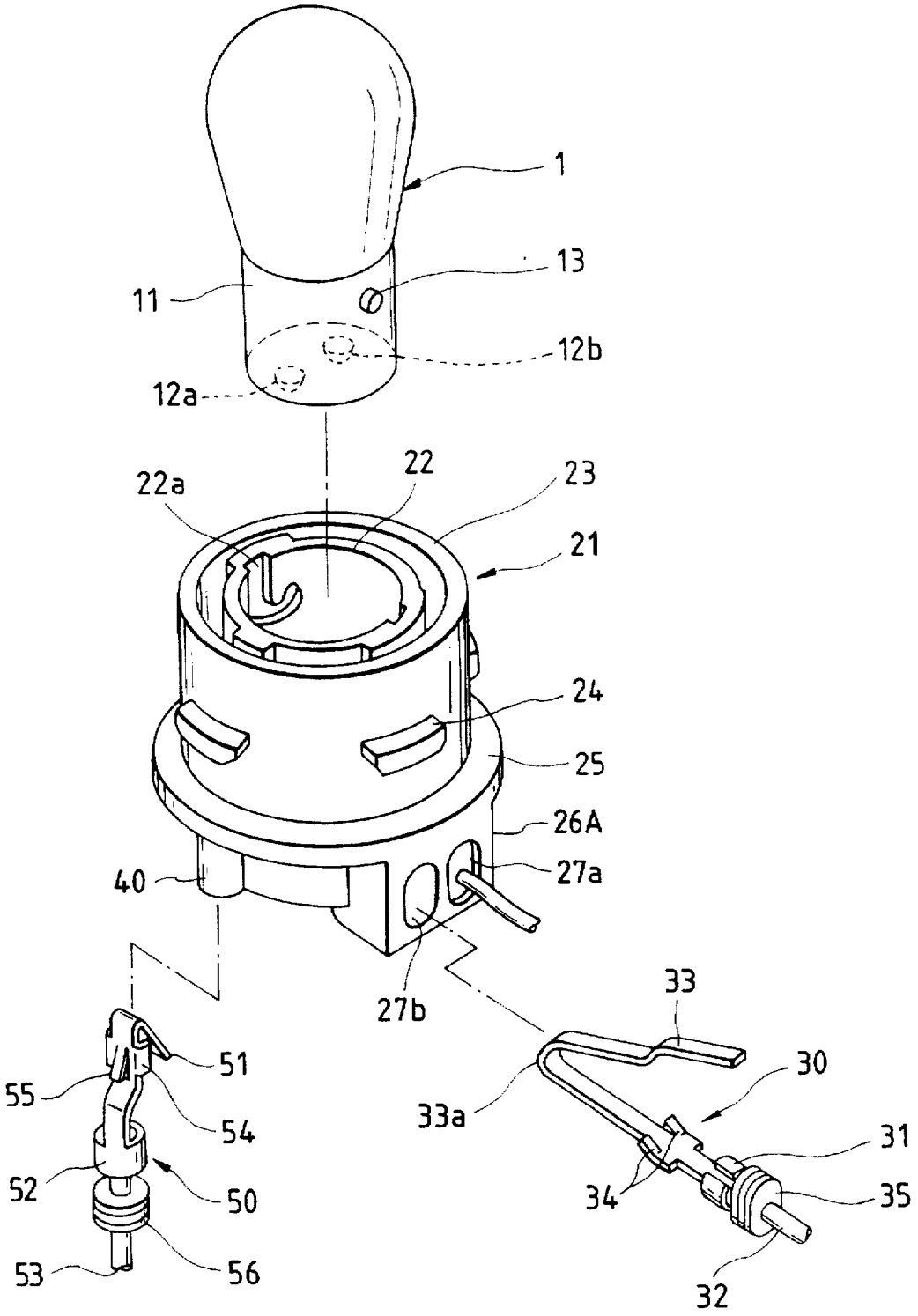
FIG. 5 is a partly exploded, perspective view of a second embodiment of the invention.

FIG. 5 shows a second embodiment of the invention. This embodiment is directed to a bulb socket for holding a bulb having two positive electrodes formed on the base thereof.

Figure 6:
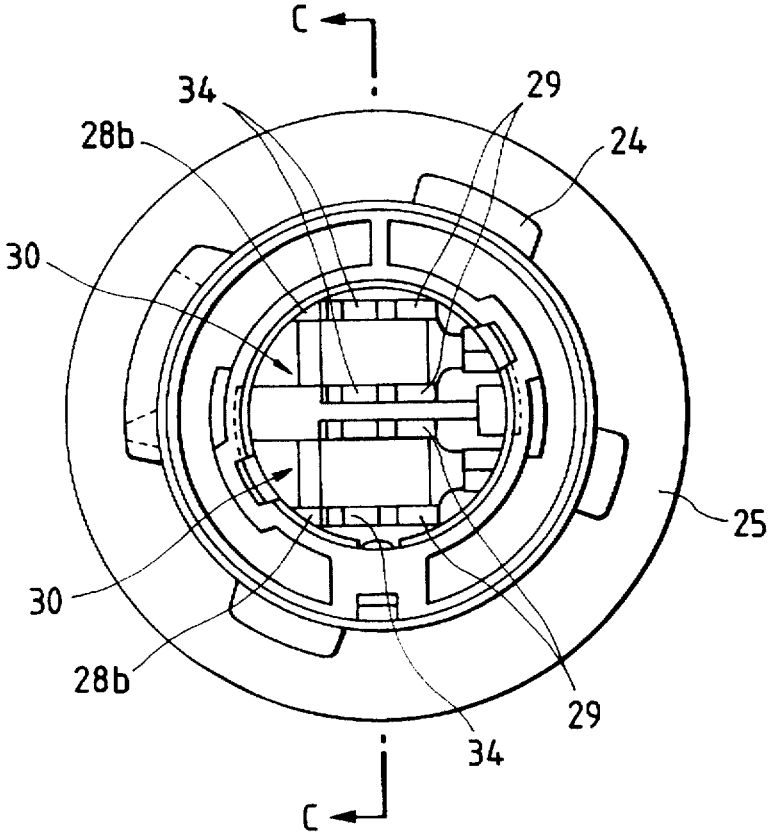
FIG. 6 is a plan view of the second embodiment.
Figure 7:
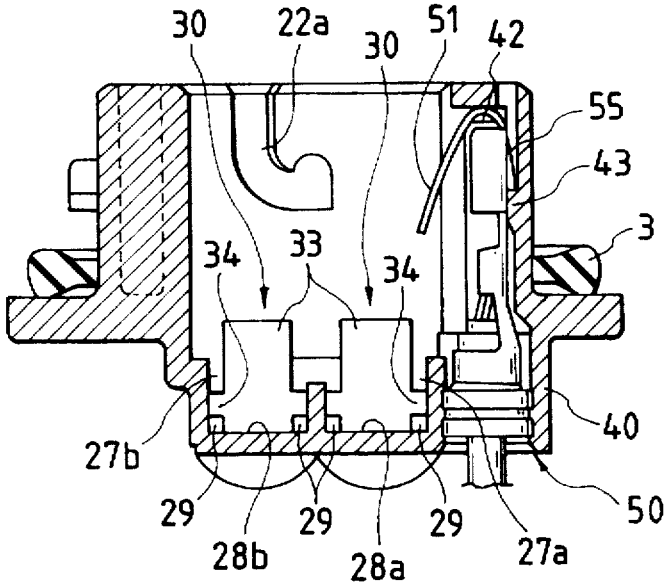
FIG. 7 is a cross-sectional view taken along the line C—C in FIG. 6.

FIG. 6 is a plan view of the bulb socket, and FIG. 7 is a cross-sectional view taken along the line C—C of FIG. 6. The cross-sectional structure as viewed along a line perpendicular to the line C—C is similar to that of FIG. 3(*a*), and therefore a further depiction of this structure is omitted. Portions corresponding to those of the first embodiment are designated by identical reference numerals, and a further explanation thereof is omitted.

In this second embodiment, a positive terminal insertion portion 26A, greater in width than that of the first embodiment, is formed perpendicularly to the axis of a tubular socket body 21, and a pair of juxtaposed positive terminal insertion ports 27*a* and 27*b*, formed in the positive terminal insertion portion 26A, are disposed on respective opposite sides of the axis of the socket body.

As in the first embodiment, the positive terminal insertion portion 26A extends generally over the entire diametrical length of a flange 25 formed on the socket body 21, and therefore the insertion ports 27*a* and 27*b* are disposed radially outwardly of an outer tube 23 of the socket body 21. A pair of parallel guide grooves 28*a* and 28*b*, corresponding respectively to the insertion ports 27*a* and 27*b*, are formed in the inner bottom surface of the socket body 21, extending along the respective axes of the insertion ports 27*a* and 27*b*. A pair of opposed, tapered projections 29 are formed integrally on the bottom surface of each of the guide grooves 28*a* and 28*b*, spaced a predetermined distance from each other in the direction of width.

Positive terminals 30 inserted into respective ones of the insertion ports 27*a* and 27*b* of the positive terminal insertion portion 26A are the same as the positive terminal in the first embodiment. These positive terminals 30 are inserted into the respective insertion ports 27*a* and 27*b* of the positive terminal insertion portion 26A, and are supported within the socket body 21. The thus-mounted positive terminals 30 have the same structure as described with respect to the first embodiment. Wings 34 of each positive terminal slide-over projection 29 are retained by the respective projections 29. In this condition, the positive terminals 30 are supported within the socket body 21. At this time, a U-shaped bent portion 33*a* of a contact portion 33 of each positive terminal 30 is received in that portion of the positive terminal insertion portion disposed radially outwardly of the outer tube of the socket body, as in the first embodiment.

A negative terminal insertion portion 40 in the form of a small cylinder is formed at the bottom portion of the socket body 21 at the outer peripheral portion thereof, a groove 41 is formed axially in the negative terminal insertion portion 40 and a region disposed outwardly of the outer periphery of an inner tube 22 of the socket body 21, and a negative terminal 50 is inserted and supported in this groove 41, as described above with respect to the first embodiment.

When the bulb 1, having the two positive electrodes 12*a* and 12*b* formed on the base 11, is inserted into the bulb socket 2, the two positive electrodes 12*a* and 12*b* contact the respective positive terminals 30, thereby energizing the bulb 1. At this time, the U-shaped bent portion 33*a* of the contact portion 33 of each positive terminal 30 is disposed in that portion of the positive terminal insertion portion 26A disposed radially outwardly of the outer tube 23 of the socket body 21, as in the first embodiment as shown in FIG. 3(*a*), and therefore the overall length of the contact portion 33 is relatively long as compared with the diameter of the socket body 21. Even if the diameter of the socket body 21 is reduced, the contact portion 33 can be made sufficiently long that a sufficient resilient force can be obtained.

With this construction, the same advantageous effects as achieved in the first embodiment can be obtained. Namely, the dimension of each positive terminal 30, received in the socket body 21, is reduced in the direction of the axis of the socket body, so that the axial length of the socket body 21 can be reduced, and, moreover, the diameter of the socket body 21 can be reduced, thereby achieving a compact design of the bulb socket 2. On the other hand, the positive terminal 30 can be made sufficiently long that the positive terminal 30 can be contacted with the positive electrode 12*a*, 12*b* of the bulb 1 with a sufficient resilient force, thereby enhancing the reliability of the electrical contact.

Each positive terminal 30 is inserted in the direction perpendicular to the axis of the tubular socket body 21, and the supporting of the positive terminal 30 is effected within the positive terminal insertion portion 26A. Therefore the bottom portion of the socket body 21 does not need to be thickened. This also contributes to the reduction of the length of the socket body 21, so that a compact design of the bulb socket 2 can be achieved. Furthermore, the positive terminal insertion portion 26A can be effectively utilized when attaching the bulb socket 2 to the lamp device through a bayonet construction.

Figure 8:
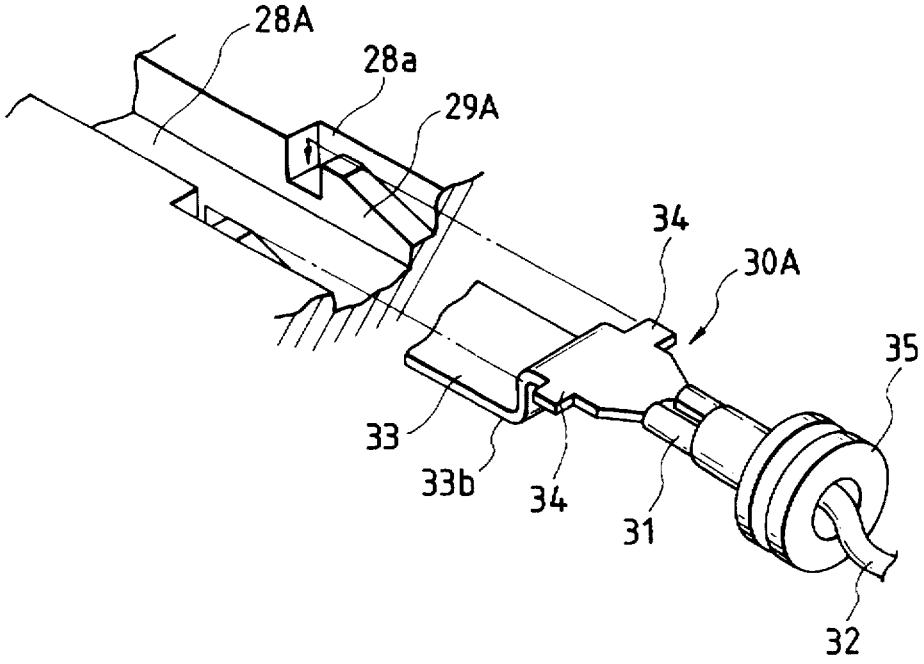
FIG. 8 is a perspective view of an important portion of a third embodiment of the invention.
Figure 9:
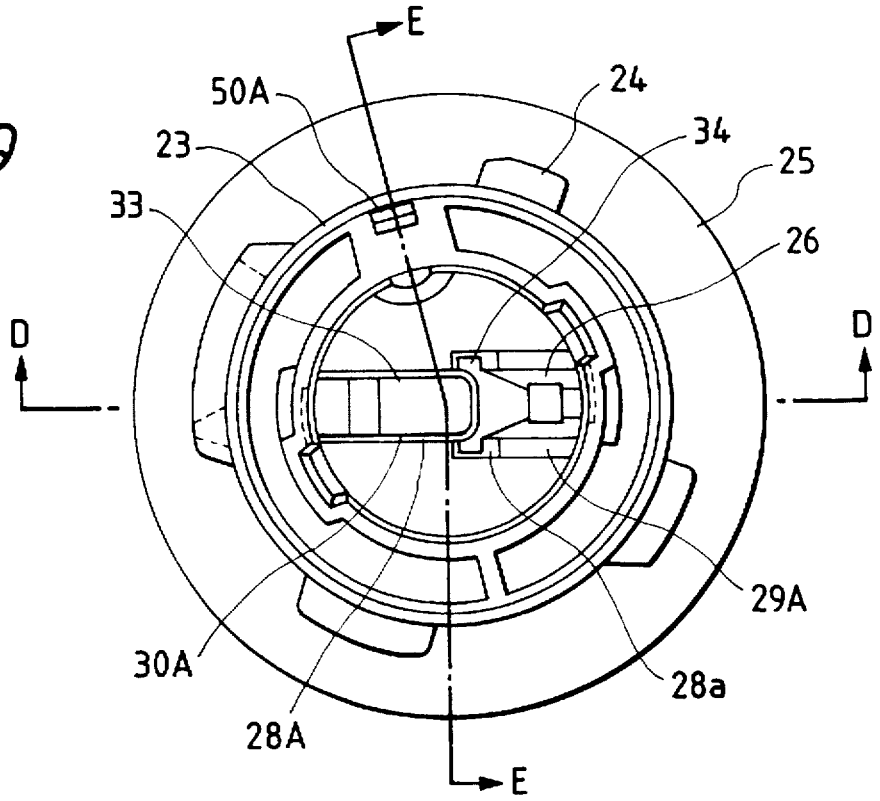
FIG. 9 is a plan view of the third embodiment.
Figure 10A:
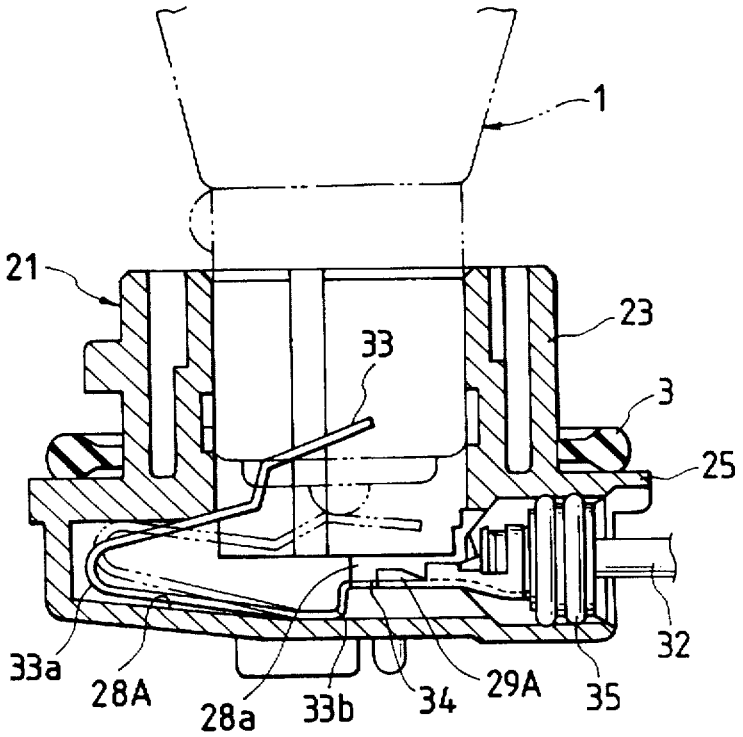
FIGS. 10(*a*) and 10(*b*) are cross-sectional views taken along the line D—D and the line E—E, respectively, in FIG. 9.
Figure 10B:
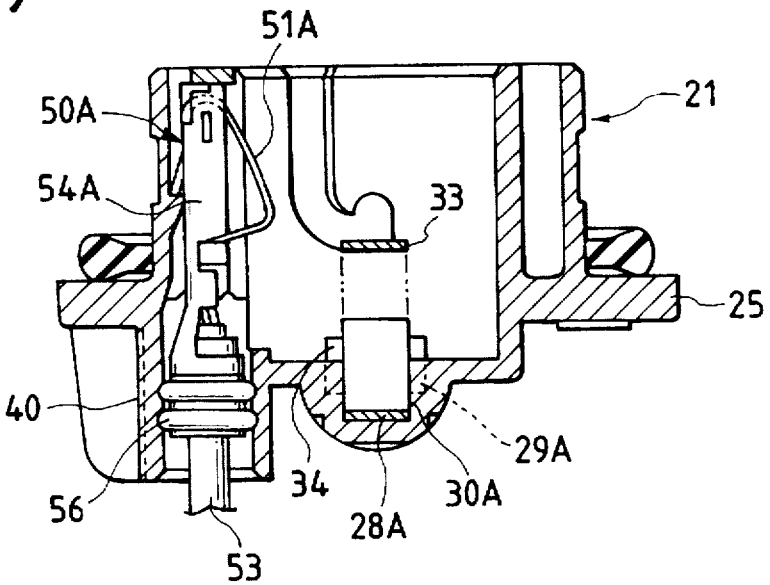

FIG. 8, which shows a third embodiment of the invention, is a fragmentary perspective view showing important portions, namely, a positive terminal and a positive terminal insertion portion. FIG. 9 is a plan view showing a condition in which the positive terminal is inserted in the positive terminal insertion portion of a socket body, and FIGS. 10(*a*) and 10(*b*) are cross-sectional views taken along the line D—D and line E—E of FIG. 9, respectively. Those portions corresponding to those of the above-described embodiments are designated by identical reference numerals.

As shown in these drawings, a contact portion 33 of the positive terminal 30A has wings 34 formed on and projecting is from a proximal end portion thereof. A front end portion of each wing 34 is not bent upwardly, in contrast with the above-described embodiments. The contact portion 33 is bent (in the direction of thickness) in a crank-shaped manner at a portion 33*b* thereof disposed forwardly of the wings 34. The positive terminal insertion portion 26 has a circular cross-section, and a rubber bushing 35 has also a circular shape.

With respect to the positive terminal insertion portion 26, the width of a guide groove 28A into which the positive terminal 30A is to be inserted is smaller than that of the above embodiments, and is generally equal to the width of the positive terminal 30A. A pair of recesses 28*a* for receiving respective ones of the wings 34 are formed in corresponding opposite side walls of the guide groove 28A, each recess 28*a* extending outwardly from the guide groove 28A a distance generally equal to the length of projection of the wing 34. Each recess 28*a* first extends parallel to the guide groove 28A toward the inner end of the positive terminal insertion portion 26, and then is perpendicularly directed toward the bottom of the guide groove 28A, thus assuming a recumbent L-shape. A tapered projection 29A is formed at the lower surface of each recess 28*a*, decreasing in height progressively toward a positive terminal insertion port 27.

Figure 11:
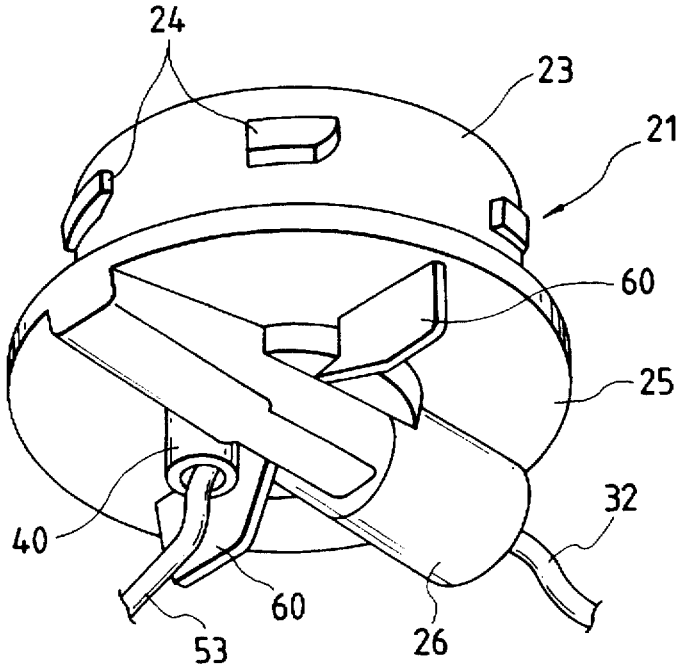
FIG. 11 is a perspective view of the third embodiment as seen from the bottom side thereof.

The bottom surface of the inner end portion of the guide groove 28A slants upwardly to gradually increase its height. With this arrangement, the amount of projection of the distal end portion of the positive terminal insertion portion 26 from the bottom surface of the socket body 21 in the axial direction thereof is reduced as much as possible, thus preventing a sharp portion from being formed, as shown in FIG. 11, which shows the bottom surface of the socket body 21. A pair of thin manipulation piece portions 60, formed on the bottom surface of the socket body 21 in substantially perpendicular relation to the positive terminal insertion portion 26, are disposed on respective opposite sides of the positive terminal insertion portion 26. These manipulation piece portions 60 depend from the bottom surface of the socket body 21, and extend longitudinally short of an outer periphery of a flange 25. By manipulating the manipulation piece portions 60, the bulb socket 2 can be easily rotated for attaching it to a lamp device.

Figure 12:
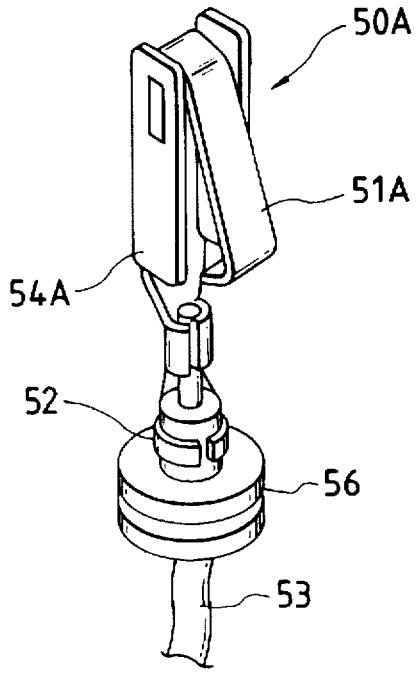
FIG. 12 is a perspective view of a negative terminal used in the third embodiment.
Figure 14:
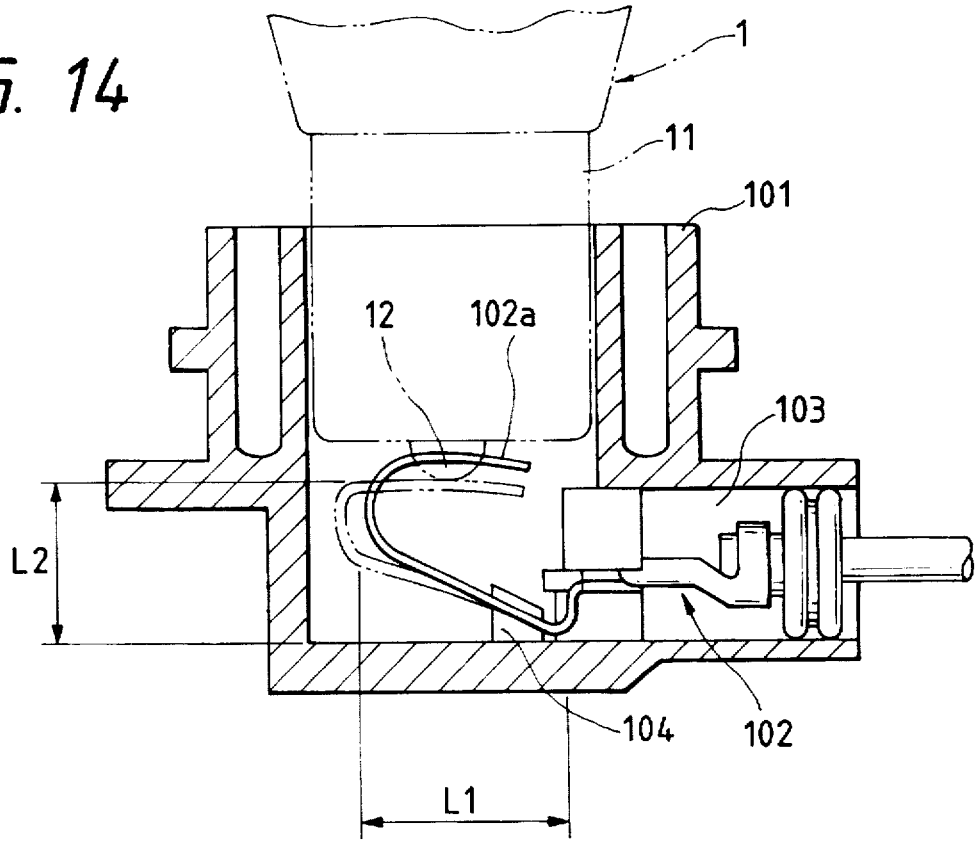
FIG. 14 is a cross-sectional view of an earlier-proposed bulb socket.

In this embodiment, a negative terminal 50A is constructed as shown in FIG. 12, namely, its distal end portion 51A, bent into a U-shape, is made sufficiently long, as also is an intermediate portion 54A of a U-shaped cross-section. With this construction, the box-like structure of the negative terminal 50A is made long, thereby increasing the mechanical strength thereof.

In this third embodiment, the positive terminal 30A is inserted into the socket body 21 through the insertion port 27 of the positive terminal insertion portion 26, with its front end first introduced thereinto. At this time, the wings 34 are guided respectively along the slanting surfaces of the tapered projections 29A in the recesses 28*a*, and then, when each wing 34 reaches the L-shaped front portion of the recess 28*a*, the wing 34 abuts against an end surface thereof and is stopped there. Thus, each wing 34 is retained in the associated recess 28*a*. In this condition, the wing 34 is held at the front end portion of the recess 28*a* intermediate the opposite ends of the guide groove 28A, and the tapered projection 29A has a vertical end surface. As a result, the wing 34 is prevented from being upwardly disengaged from the recess 28*a*. The crank-shaped bent portion 33*b* of the contact portion 33 of the positive terminal 30A is held against the bottom surface of the guide groove 28A. Since the width of the guide groove 28A is generally equal to the width of the positive terminal 30A, the positive terminal 30A is held against movement by the opposite side walls of the guide groove 28A.

Thus, because the positive terminal 30A is engaged with these various portions, the positive terminal 30A is stably held in the guide groove 28A against movement in the directions of the length, height and width, and hence is positioned relative to the socket body 21. In this condition, a U-shaped bent portion 33*a* of the contact portion 33 is disposed in that portion of the positive terminal insertion portion 26 disposed radially outwardly of an outer tube 23 of the socket body 21, as in the above embodiments.

In this third embodiment, the positive terminal 30A and the positive terminal insertion portion 26 are slightly different from those of the above embodiments, and as a result the positive terminal 30A can be held in the socket body more stably than in the case of the first embodiment. The negative terminal 50A has an increased mechanical strength, and the reliability of contact with the bulb is improved. Furthermore, due to the provision of the manipulation piece portions 60 on the bottom surface of the socket body 21, the bulb socket 2 can be easily attached to and detached from the lamp device.

Figure 13A:
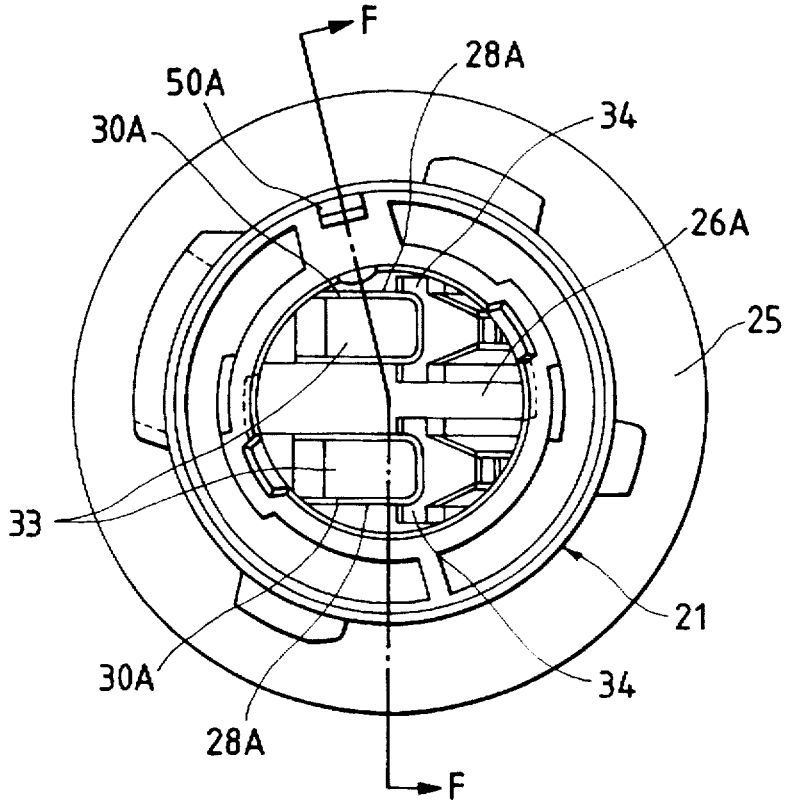
FIGS. 13(*a*) and 13(*b*) are a plan view of a fourth embodiment and a cross-sectional view taken along the line F—F in FIG. 13(*a*), respectively.
Figure 13B:
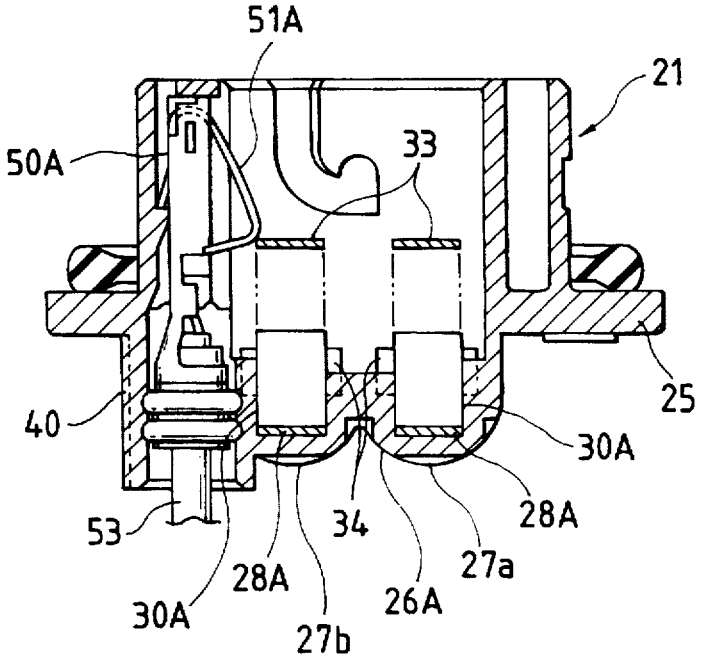

FIGS. 13(*a*) and 13(*b*) show a further modified bulb socket for holding a bulb with two positive electrodes as in the second embodiment, in which a positive terminal and a positive terminal insertion portion as used in the third embodiment are adapted. FIG. 13(*a*) is a plan view, and FIG. 13(*b*) is a cross-sectional view taken along the line F—F of FIG. 13(*a*). In this fourth embodiment, a positive terminal insertion portion 26A of a greater width extends in a direction perpendicular to an axis of a tubular socket body 21, as in the second embodiment. A pair of juxtaposed positive terminal insertion ports 27*a* and 27*b* are formed in this positive terminal insertion portion, and are disposed respectively on opposite sides of the axis of the socket body. As described in the third embodiment, a guide groove 28A for receiving the positive terminal 30A, a recess 28*a* and a tapered projection 29A are provided in each of those portions of the positive terminal insertion portion 26A corresponding to ones of the positive terminal insertion ports 27*a* and 27*b*. As described with respect to the second embodiment, the two positive terminals 30A are retained in respective ones of the guide grooves 28A, and are held within the socket body in parallel relation to each other.

The amount of projection of the positive terminal insertion portion from the bottom surface of the socket body 21 gradually decreases toward its distal end, and a pair of manipulation piece portions disposed perpendicular to the positive terminal insertion portion are formed on this bottom surface, as described with respect to the third embodiment.

In this fourth embodiment also, the two positive terminals 30A can be stably held in the positive terminal insertion portion 26A. Due to the provision of the manipulation piece portions 60 on the bottom surface of the socket body 21, the bulb socket 2 can be easily attached to and detached from the lamp device.

As described above, in the present invention, the positive terminal, which is provided at the inner bottom portion of the tubular socket body (which receives the base of the bulb) and contacts the positive electrode formed on the base of the bulb, is longer than the diameter of the socket body, and, moreover, this positive terminal is supported in the positive terminal insertion portion having a length greater than the diameter of the socket body in the diametrical direction. Therefore, even if the diameter of the socket body is reduced so as to achieve a compact design of the socket, the length of the positive terminal is not always be reduced, the positive terminal provides a sufficient resilient force, and the reliability of electrical contact with the bulb is secured.

What is claimed is:

1. A bulb socket comprising:

a tubular body for receiving a base of a bulb; and a positive terminal insertion portion formed at a bottom portion of said socket body, said positive terminal insertion portion opening in a direction perpendicular to a longitudinal axis of said socket body; at least one positive terminal inserted into said socket body through said positive terminal insertion portion and held on an inner bottom portion of said socket body, said positive terminal contacting a positive electrode formed on said base of said bulb, said positive terminal insertion portion being formed generally diametrically of said socket body and having a length larger than a diameter of said socket body, said positive terminal being supported in said positive terminal insertion portion along the length thereof, and said positive terminal having a length larger than the diameter of said socket body; a negative terminal insertion portion with a first opening at the bottom of said socket body communicating with an axially disposed longitudinal slot and a negative terminal having a narrow longitudinal shape and being insertable into said first opening and supported in said longitudinal slot on an inner peripheral surface of said socket body, said negative terminal contacting a negative electrode on said base of said bulb.

2. A bulb socket according to claim 1, further comprising a flange larger in diameter than said socket body formed at a bottom portion of said socket body, said positive terminal insertion portion projecting from bottom surfaces of said socket body and said flange in the direction of the axis of said socket body, opposite ends of said positive terminal insertion portion being disposed generally at an outer periphery of said flange.

3. A bulb socket according to claim 1, wherein one said positive terminal is provided, said positive terminal insertion portion being formed diametrically of said socket body and receiving said positive terminal therein, said one positive terminal contacting a single positive electrode formed on the base of the bulb.

4. A bulb socket according to claim 1, wherein two of said positive terminals are provided, and wherein said positive terminal insertion portion is formed diametrically of said socket body and receives said two positive terminals therein in such a manner that said two positive terminals are held parallel to each other, said two positive terminals being adapted to contact two respective positive electrodes formed on the base of the bulb.

5. A bulb socket according to claim 1, wherein a guide groove is formed in said positive terminal insertion portion, and said positive terminal comprises a pair of wings formed on and projecting from respective opposite sides thereof, said wings being engageable with respective ones of a pair of projections provided in said guide groove, said positive terminal being inserted into said guide groove, each of said wings having a slanting front end portion which slides over said projection when inserting said positive terminal into said positive terminal insertion portion.

6. A bulb socket according to claim 4, wherein a guide groove is formed in said positive terminal insertion portion, and said positive terminal comprises a pair of wings formed on and projecting from respective opposite sides thereof, said wings being engageable with respective ones of a pair of projections provided in said guide groove, said positive terminal being inserted into said guide groove, each of said wings having a slanting front end portion which slides over said projection when inserting said positive terminal into said positive terminal insertion portion.

7. A bulb socket according to claim 1, wherein a guide groove for receiving said positive terminal is formed in said positive terminal insertion portion, and wherein said positive terminal comprises a pair of wings formed on and projecting from respective opposite sides thereof, said guide groove being generally equal in width to said positive terminal, a pair of recesses for retaining respective ones of said wings being formed in opposite side walls of said guide groove.

8. A bulb socket according to claim 4, wherein a guide groove for receiving said positive terminal is formed in said positive terminal insertion portion, and wherein said positive terminal comprises a pair of wings formed on and projecting from respective opposite sides thereof, said guide groove being generally equal in width to said positive terminal, a pair of recesses for retaining respective ones of said wings being formed in opposite side walls of said guide groove.

9. A bulb socket according to claim 2, further comprising a thin manipulation piece portion formed on one of the bottom surfaces of said socket body and the flange, and extending perpendicular to the direction of length of said positive terminal insertion portion.

10. A bulb socket according to claim 6, further comprising a thin manipulation piece portion formed on one of the bottom surfaces of said socket body and the flange, and extending perpendicular to the direction of length of said positive terminal insertion portion.

11. A bulb socket according to claim 2, wherein one said positive terminal is provided, said positive terminal insertion portion being formed diametrically of said socket body and receiving said positive terminal therein, said one positive terminal contacting a single positive electrode formed on the base of the bulb.

12. A bulb socket according to claim 2, wherein two of said positive terminals are provided, and wherein said positive terminal insertion portion is formed diametrically of said socket body and receives said two positive terminals therein in such a manner that said two positive terminals are held parallel to each other, said two positive terminals being adapted to contact two respective positive electrodes formed on the base of the bulb.

13. A bulb socket according to claim 1 wherein said negative terminal is supported longitudinally on said inner peripheral surface.

14. A bulb socket according to claim 13, wherein said negative terminal is supported in a longitudinal slot.

15. A bulb socket according to claim 1, further comprising a negative terminal insertion portion, said negative terminal opening in a direction parallel to a longitudinal axis of said socket body.

* * * * *